US005882103A

United States Patent [19]

Brantley et al.

[11] Patent Number: 5,882,103

[45] Date of Patent: Mar. 16, 1999

[54] SOCKET WRENCH WITH ILLUMINATION

[75] Inventors: Stephen L. Brantley; Tim S. Moore, both of Las Vegas, Nev.

[73] Assignee: JS Products, Inc., Las Vegas, Nev.

[21] Appl. No.: 162,632

[22] Filed: Sep. 28, 1998

Related U.S. Application Data

[63] Continuation-in-part of Ser. No. 42,207, Mar. 12, 1998, Pat. No. 5,826,968.

[51] Int. Cl.[6] ..... B25B 23/18

[52] U.S. Cl. ..... 362/119; 362/109; 362/253

[58] Field of Search ..... 362/109, 119, 362/120, 253

[56] References Cited

U.S. PATENT DOCUMENTS

| | | | |
|---|---|---|---|
| 2,288,093 | 6/1942 | Kaffenberger et al. | 362/120 |
| 2,408,601 | 10/1946 | Blauvelt | 362/120 |
| 4,107,765 | 8/1978 | Singleton et al. | 362/120 |
| 4,253,134 | 2/1981 | Barnaby | 362/119 |
| 4,324,158 | 4/1982 | Le Roy | 81/60 |
| 5,477,434 | 12/1995 | Reed | 362/119 |
| 5,502,625 | 3/1996 | Peng | 362/119 |
| 5,550,719 | 8/1996 | Kuo | 362/120 |
| 5,577,829 | 11/1996 | Hall | 362/119 |
| 5,826,968 | 10/1998 | Brantley et al. | 362/119 |

*Primary Examiner*—Stephen Husar
*Attorney, Agent, or Firm*—John Edward Roethel

[57] ABSTRACT

A socket extension is provided with a internal light assembly and power supply and is joined together with a socket handle and a socket tool to form a socket wrench so that light may be provided directly to the work area when the socket wrench is being used. The socket extension has a hollow socket body which encases a battery, a light assembly mounted adjacent to the battery and a socket tool connection head which surrounds the light assembly. The light assembly is an assembled part having a flat light mounting disk, a bulb holder attached to a first side of the light mounting disk and a bulb attached to the bulb holder. The second side of the light mounting disk has a spring mounting disk attached thereto. A coil spring is attached to the spring mounting disk. The socket tool connection head function as a mounting element for the socket tool and the socket tool connection head comprises a hexagonal body sized to press fit into the hollow extension body and is securely held therein by any suitable connection, such as a ball and detent assembly. An annular channel is provided in the socket tool connection head to receive an O-ring that assists in joining the socket tool to the socket tool connection head.

24 Claims, 7 Drawing Sheets

SOCKET WRENCH WITH ILLUMINATION

CROSS REFERENCE TO RELATED APPLICATION

This application is a Continuation-in-Part of application Ser. No. 09/042,207, filed Mar. 12, 1998, entitled "Socket Wrench with Illumination", now U.S. Pat. No. 5,826,968.

BACKGROUND OF THE INVENTION

This invention relates to a socket wrench with illumination, and more particularly to a socket wrench extension that is used in combination with a socket wrench, the socket wrench extension containing a light source and power supply mounted in the hollow interior thereof.

Over the years, there have been many devices proposed that utilize a light source in connection with a hand tool. Screwdrivers have had light bulbs incorporated therein with the light projecting therefrom either along the axis of the screwdriver or offset from the axis. Even flashlights have been provided with tool bits mounted on the head thereof to assist the user by providing light directed at the workpiece.

It is often desirable to have an additional source of light that can be directed at the work area. Many times a mechanic must work in confined spaces with little available light. Automobile engines often have bolts located in the nooks and crannies of the engine and the ambient or overhead light in the garage area is just not sufficient to illuminate the work space so that the bolt is readily visible to the mechanic. Some mechanics try and use a wrench in one hand and a flashlight in the other hand to shine light into the work area where the bolt is located. However, many times it is necessary to use both hands on the wrench, especially when socket wrenches with extensions are used. It is therefore desirable to have a light source incorporated directly into the work tool, particularly into a socket wrench, so that the light needed to illuminate the work area can be projected directly from the tool and onto the bolt.

To achieve this desired result, ratchet-type wrenches have been provided with light sources to illuminate the work area. U.S. Pat. No. 4,324,158 (Le Roy) discloses a ratchet-type wrench that has a light bulb positioned in the handle of the socket wrench. This patent discloses a conventional ratchet-type socket wrench that has the handle area hollowed out to receive one or more batteries to provide a power supply for a light bulb. In one embodiment, the light bulb is mounted in the lug of the ratchet head with an opening provided in the face of the lug to allow the light from the light bulb to be directed into the work area. Wires connect the light bulb to the batteries and the handle of the socket wrench includes a switch to turn the light bulb on and off.

The Le Roy patent also shows an embodiment in which the light bulb is mounted in a swivelable assembly just below the head of the socket wrench. This allows the light bulb to be rotated to vary the angle at which the light is directed into the work area.

The Le Roy patent does not solve the problem of directing light to the work area when a socket extension is needed on the socket wrench. Often when using a socket wrench, the mechanic must still access a bolt that is in a tight location and the head of the socket wrench cannot reach the head of the bolt. In such a situation, it would be helpful to have a light source physically located in the socket extension so that the light can be directed onto the head of the bolt even when the bolt is located a distance from the head of the socket wrench.

U.S. Pat. No. 4,253,134 to Barnaby discloses a socket wrench extension that incorporates a light bulb, one or more batteries and a control switch in the hollow interior thereof. The socket extension is hollow throughout and has a handle receiving end that receives the lug on the head of the socket wrench handle. The other end of the hollow extension receives the socket of the size needed to interact with the bolt head. Intermediate the two ends of the extension is a hollow space that contains the light bulb, one or more batteries and a switch. The light bulb is mounted in a bulb plug and is set back from the end of the socket extension. The end of the socket extension also has a lens covering the end opening to protect the light bulb from grease or oil and which permits easy cleaning of the lens. One or more dry cell batteries are aligned in the hollow interior of the extension behind the light bulb with the end contact of the battery in contact with the end of the light bulb to provide an electrical connection. A contact switch is mounted adjacent the handle receiving end of the extension. The contact switch is carried by a plastic housing that is screwed into the handle receiving end of the extension. A spring is provided between the end of the battery and the contact plug to bias the contact plug away from the battery. When the lug of the socket head is connected to the handle receiving end of the extension, the force of the lug on the contact plug pushes the contact plug into electrical contact with the end of the battery. This completes the electrical circuit and causes the light to illuminate.

The drawback of the Barnaby device is that the amount of space required in the hollow interior of the extension structurally weakens the extension and limits the size of sockets that could practically be used as well as limits the amount of torque that can be applied to the bolt head.

Another socket extension that includes a light source on the hollow interior thereof is disclosed in U.S. Pat. No. 5,477,434 to Reed. Similar to the Barnaby configuration, the Reed device has a hollow socket extension with one open end for receiving the lug from the head of a socket handle and another open end for receiving the socket. The Reed extension is hollow throughout and has mounted in the interior thereof a light assembly which is carried within a tubular casing made of an electrically insulating material such as plastic. The components of the light assembly are a light bulb, a coil spring, a battery and a push button. Once these components are assembled within the tubular casing, the ends of the tubular casing are rolled over to form thickened rims to narrow the interior opening and to retain the components of the light assembly inside the tubular casing. The coil spring is biased to keep the battery away from the light bulb when light is not needed. The push button is a T-shaped member with its flat end resting against the end of the battery. When the lug of the socket head is inserted into the socket extension, the end of the lug engages the push button and forces the push button firmly against the battery. This forces the battery to move along the interior of the extension and the end contact of the battery comes into contact with the electrical contact on the end of the light bulb. This provides electrical current to the light bulb causing it to illuminate.

One drawback of the Reed configuration is that all of the components of the light assembly are encapsulated inside the tubular casing once the ends are rolled over. Thus, if one of the components needs to be replaced, e.g. the battery expires or the light bulb burns out, there is no way to replace the single non-working component. In the Reed configuration, the entire light assembly including the surrounding tubular casing must be replaced if one component becomes non-functioning. This creates an unnecessary expense to the mechanic, especially since the light assembly encapsulated within the plastic casing is not readily available at the local hardware store and, no doubt, must be obtained directly from the manufacturer.

It is an object of the present invention to provide, for use with a socket wrench assembly, a socket extension with an internal light source in which either the battery or the light bulb can be separately replaced. It is a further object of the present invention to provide a novel structure for the light assembly.

It is a feature of the present invention that the construction of the socket extension allows the components of the internal light assembly to be easily disassembled so that either the light bulb or the battery can be replaced when needed. The light assembly includes a light mounting disk that protects the light bulb and light bulb holder from being harmed by any leakage from the battery.

It is an advantage of the present invention that each component of the internal light assembly can be replaced when needed rather than incurring the unnecessary expense of replacing the entire internal light assembly when only one component thereof needs replacement.

Other objects, features and advantages of the present invention will become apparent from a consideration of the following detailed description.

SUMMARY OF THE INVENTION

A socket extension is provided with a internal light assembly and power supply and is joined together with a socket handle and a socket tool to form a socket wrench so that light may be provided directly to the work area when the socket wrench is being used. The socket extension has a hollow socket body which encases a battery, a light assembly mounted adjacent to the battery and a socket tool connection head which surrounds the light assembly. The light assembly is an assembled part having a flat light mounting disk, a bulb holder attached to a first side of the light mounting disk and a bulb attached to the bulb holder. The second side of the light mounting disk has a spring mounting disk attached thereto. A coil spring is attached to the spring mounting disk. The socket tool connection head functions as a mounting element for the socket tool and the socket tool connection head comprises a hexagonal body sized to press fit into the hollow extension body and is securely held therein by means of any suitable connection, such as at least one ball and detent assembly. An annular channel is provided in the socket tool connection head to receive an O-ring that assists in joining the socket tool to the socket tool connection head.

DETAILED DESCRIPTION OF THE PREFERRED EMBODIMENTS

Figure 1:
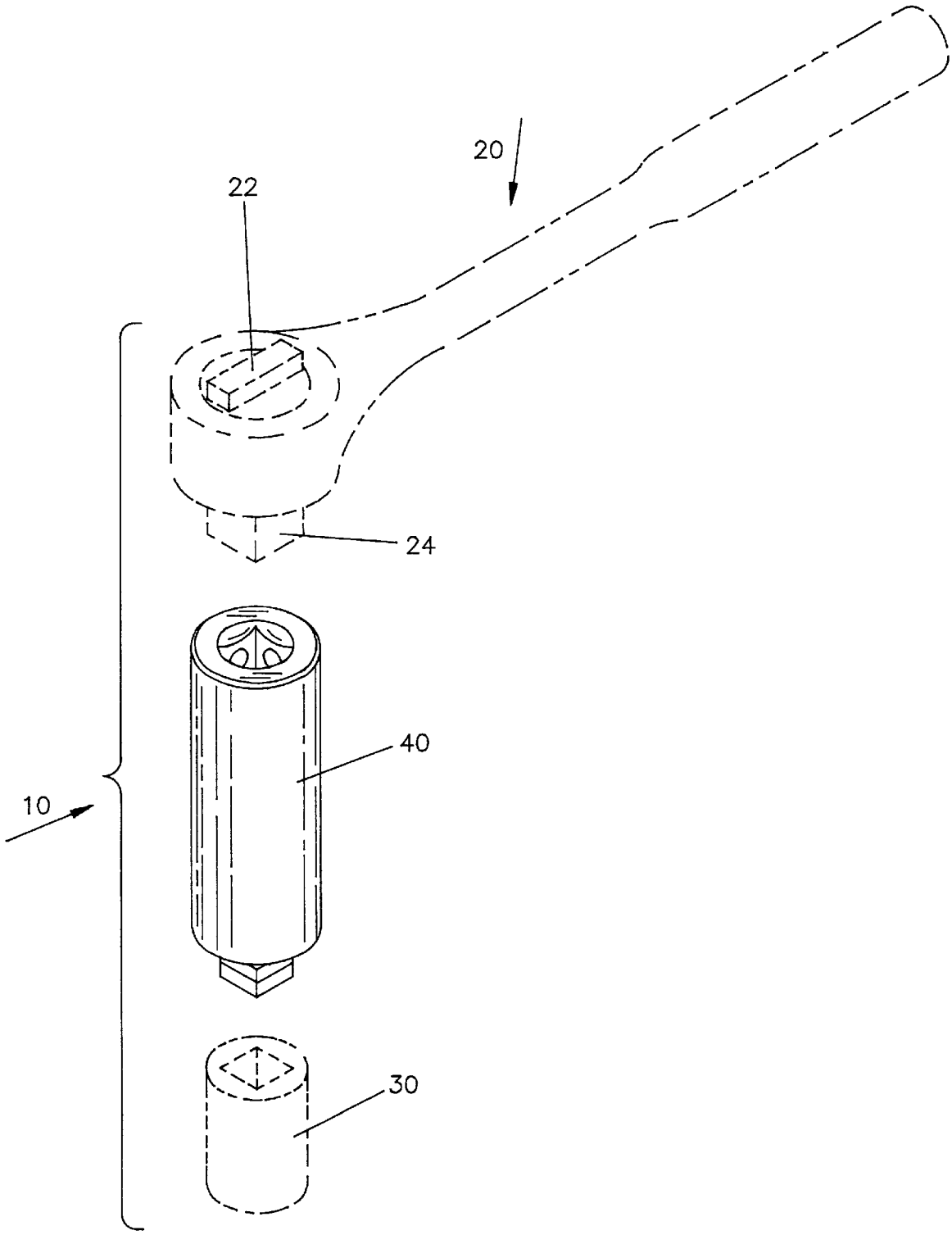
FIG. 1 shows an exploded view of the socket extension of the present invention along with a socket handle and socket tool that are used with the socket extension.

A socket wrench assembly is shown generally at 10 in FIG. 1. The socket wrench assembly 10 has a socket wrench handle 20 and a socket tool 30 which can be joined together with a socket extension 40 when it is desired to have light available to illuminate the work area.

The socket wrench handle 20 can be any conventional socket wrench that uses a ratchet mechanism 22 to switch the direction of the ratchet action. Details of a typical socket handle are shown in U.S. Pat. No. 4,324,158 and U.S. Pat. No. 5,477,434, the disclosures of each of which are incorporated herein.

The socket tool 30 can also be any conventional socket tool that conforms to the size and shape of the bolt head on a bolt. The typical socket tool has a square opening to receive the socket tool connection head 70, as will be explained below, on the socket tool mounting element 60 which is a part of the socket extension 40.

The socket extension 40 is used when the bolt head is located in a constricted space and cannot be accessed by a socket wrench handle with a socket tool mounted directly thereon. The socket extension 40 can be any suitable length as long as the socket extension 40 is long enough to accommodate the light elements which are carried therein in the present invention.

Figure 2:
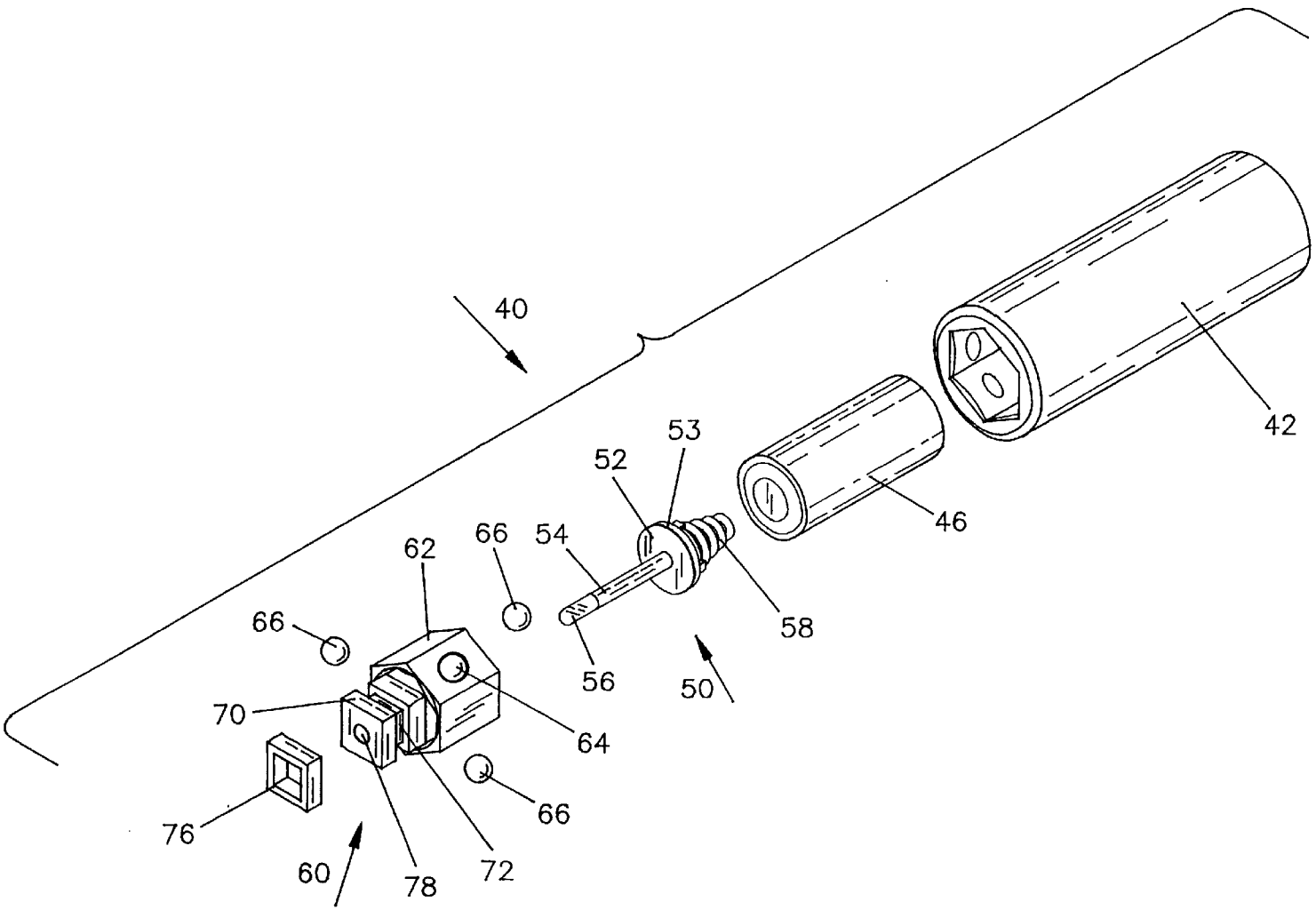
FIG. 2 shows an exploded view of the socket extension of the present invention.

The socket extension 40 of the present invention is shown in exploded view in FIG. 2 and includes an extension body 42 which has a hollow interior. The extension body 42 can have any suitable internal cross section, although in the preferred embodiment of the present invention the internal cross section is hexagonal. The external cross section of the extension body 42 can also be any suitable shape, although in the preferred embodiment of the present invention, the external cross section is circular which is conventional for socket extensions.

Positioned in the hollow interior of the extension body 42 is the battery 46 which functions as the power supply of the light assembly of the present invention. While one battery is shown in the drawings, multiple batteries can be used if desired.

Figure 3:
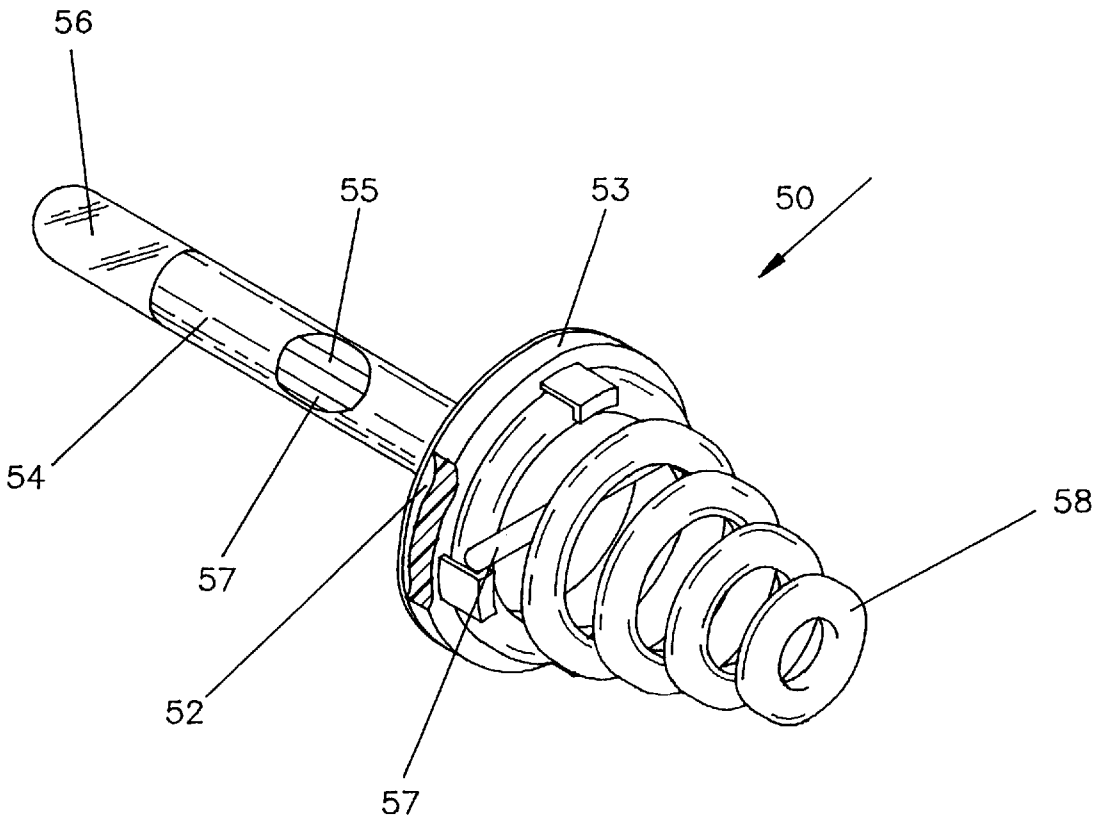
FIG. 3 shows an isometric view of the light assembly of the present invention.

Positioned adjacent the battery 46 is a light assembly 50 the details of which are shown in FIG. 3. The light assembly 50 includes a light mounting disk 52 made of a metallic or other electrically conductive material. The light mounting disk 52 has a diameter which is approximately the diameter of the battery 46 so that when the light assembly 50 is positioned in operable engagement with the battery 46, the light mounting disk 52 will close off the end of the extension body 42. The light mounting disk 52 therefore acts as a barrier to prevent any battery leakage from damaging the light bulb 56 or the light bulb holder 54. The light mounting disk 52 has mounted thereon a bulb holder 54 at the end of which is a bulb 56. Any suitable type of light can be used as the bulb 56.

Mounted flush with the light mounting disk 52, and on the side thereof opposite from the light bulb holder 54, is a spring mounting disk 53. The spring mounting disk 53 and the light mounting disk 52 preferably have the same diameters. On the battery side of the light mounting disk 52 there is provided a spring 58 which is attached to the spring mounting disk 53 by one or more brackets 59.

Extending from the bulb 56 are a first wire 55 and a second wire 57. The first wire 55 is terminated in contact with the light mounting disk 52.

The second wire 57 extends through the light mounting disk 52 and through the spring mounting disk 53 and contacts the spring 58.

Also provided is a socket tool mounting element 60 which is comprised of a hexagonal body 62 and a socket tool connection head 70. The hexagonal body 62 can have any suitable configuration, but preferably it is hexagonal so that it conforms to the interior configuration of the extension body 42. The socket tool mounting element 60 is securely joined to the extension body 42 in any suitable manner. For example, one or more ball recesses 64 each with its own cooperating ball 66 and small spring (not shown) comprises a ball and detent assembly to snugly connect the socket tool mounting element 60 into the interior of the extension body 42 when the parts are assembled for use. The socket tool mounting element 60 also has a central internal passageway (not shown) that receives the bulb holder 54 and bulb 56.

Attached to or integrally formed with the socket tool mounting element 60 is the socket tool connection head 70. The outer configuration of the socket tool connection head 70 is sized to interfit with the interior configuration of the socket tool 30 so that the socket tool 30 can be mounted onto the socket tool connection head 70. The socket tool connection head 70 is provided with an annular channel 72 which receives an O-ring 76. In the preferred embodiment, the O-ring has a generally square configuration to correspond to the cross section of the socket tool connection head 70, but any suitable cross section for the O-ring 76 can be used.

When the socket tool 30 is pressed onto the socket tool connection head 70, the O-ring 76 securely holds the socket tool 30 in place. The socket tool connection head 70 also has an internal passageway 78 that aligns with the internal passageway in the socket tool mounting element 60. The bulb holder 54 and bulb 56 also protrude into the socket tool connection head 70 with the bulb 56 actually slightly extending out of the end of the internal passageway 78 of the socket tool connection head 70 so that light can be emitted into the interior of the socket tool 30 and from there onto the work area.

The parts of the socket extension 40 are assembled together and are available to the workman when an extension tool with a light source is needed in the workplace. In use, the workman selects the appropriate size socket tool 30 needed for the job and snaps the socket tool 30 onto the socket tool connection head 70. A socket wrench handle 20 is snapped into the end of the extension body 42.

The electrical circuit is completed to illuminate the bulb 56 from first wire 55, through the light mounting disk 52, through the extension body 42, through the lug 24, through the battery 46, through the spring 58 to the second wire 57. When the job is completed, the socket wrench handle 20 is disassembled from the socket extension 40 which causes the light to turn off.

When the light bulb wears out, it is a simple matter to disassemble the components of the socket extension 40 and replace the light assembly 50. Likewise, when the batteries expires, again it is easy to disassemble the socket extension 40 and put in a replacement battery. Unlike the devices previously used, the light assembly 50 and the battery 46 are separate parts and can be replaced independently whenever the need arises.

In use, a high amount of torque can be generated at the point of contact between the socket tool 30 and the bolt head. This torque is transferred into the socket tool extension head 70 and into the hexagonal body 62. By making the socket tool mounting element 60 a separate part from the extension body 42, additional mechanical strength can be added to the socket tool mounting element 60 by making this part a more solid metal piece. This allows a higher amount of torque to be handled by the socket extension 40.

The construction of the present invention also allows the light assembly 50 and battery 46 to be completely removed from the interior of the extension body 42 when the worker only needs to have a socket extension but does not need light in the work area.

Figure 4:
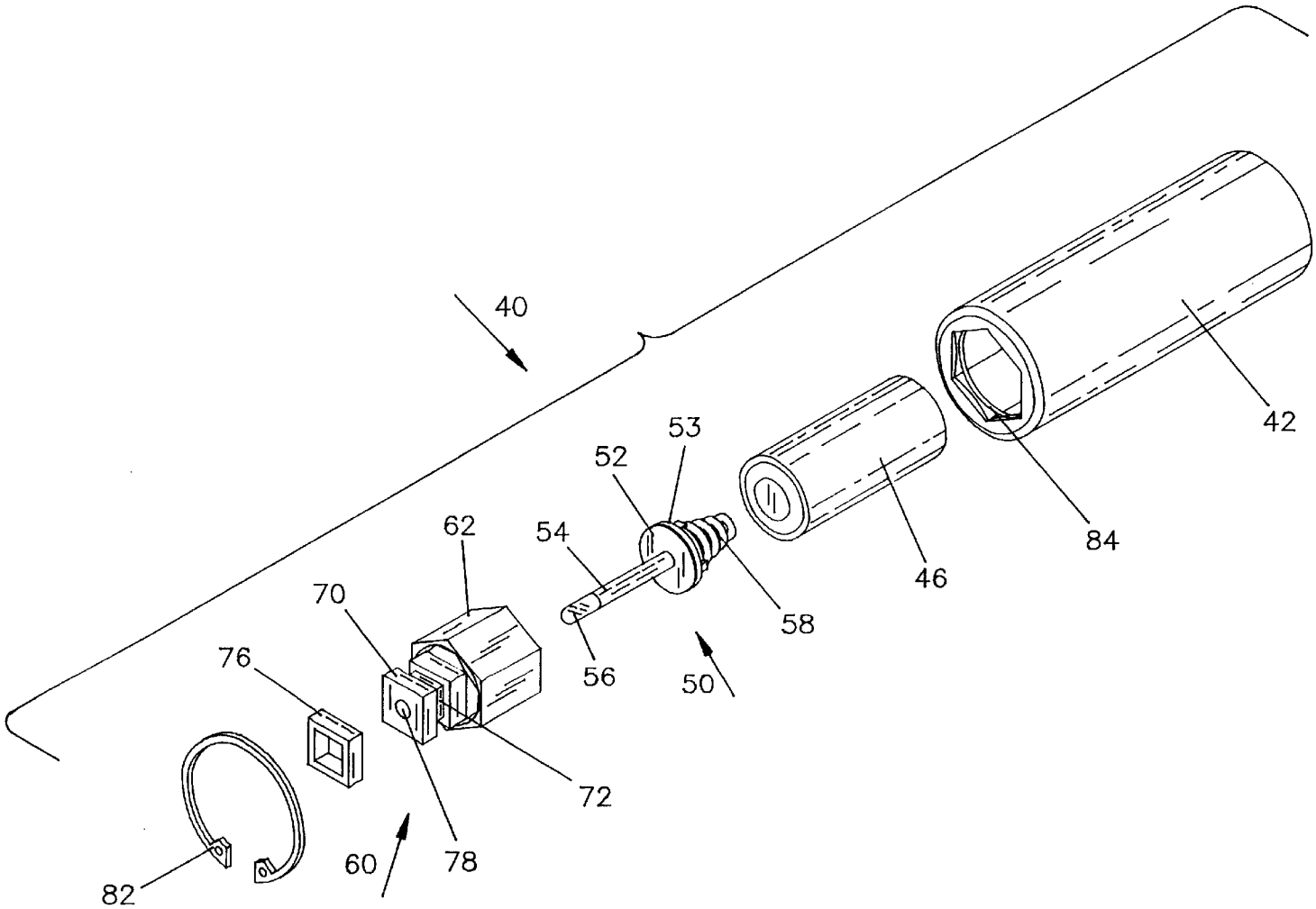
FIG. 4 shows an exploded view of an alternative embodiment of the socket extension of the present invention.

FIG. 4 shows an alternative embodiment of the present invention which uses a snap ring connection to secure the socket tool mounting element into the extension body 42. Instead of the ball and detent connection shown in FIG. 2, there is provided a groove 84 in the interior of the extension body 42 sized to receive a snap ring 82. When the battery 46, the light assembly 50 and the hexagonal body 62 are assembled into the interior of the extension body 42, the snap ring 82 is set into the groove 84 using a conventional snap ring setting tool to hold these elements inside the extension body 42. When it is necessary to replace one of these elements, the snap ring 82 can easily be removed from the groove 84 using the snap ring setting tool to allow the elements to be removed from the extension body 42.

Figure 5:
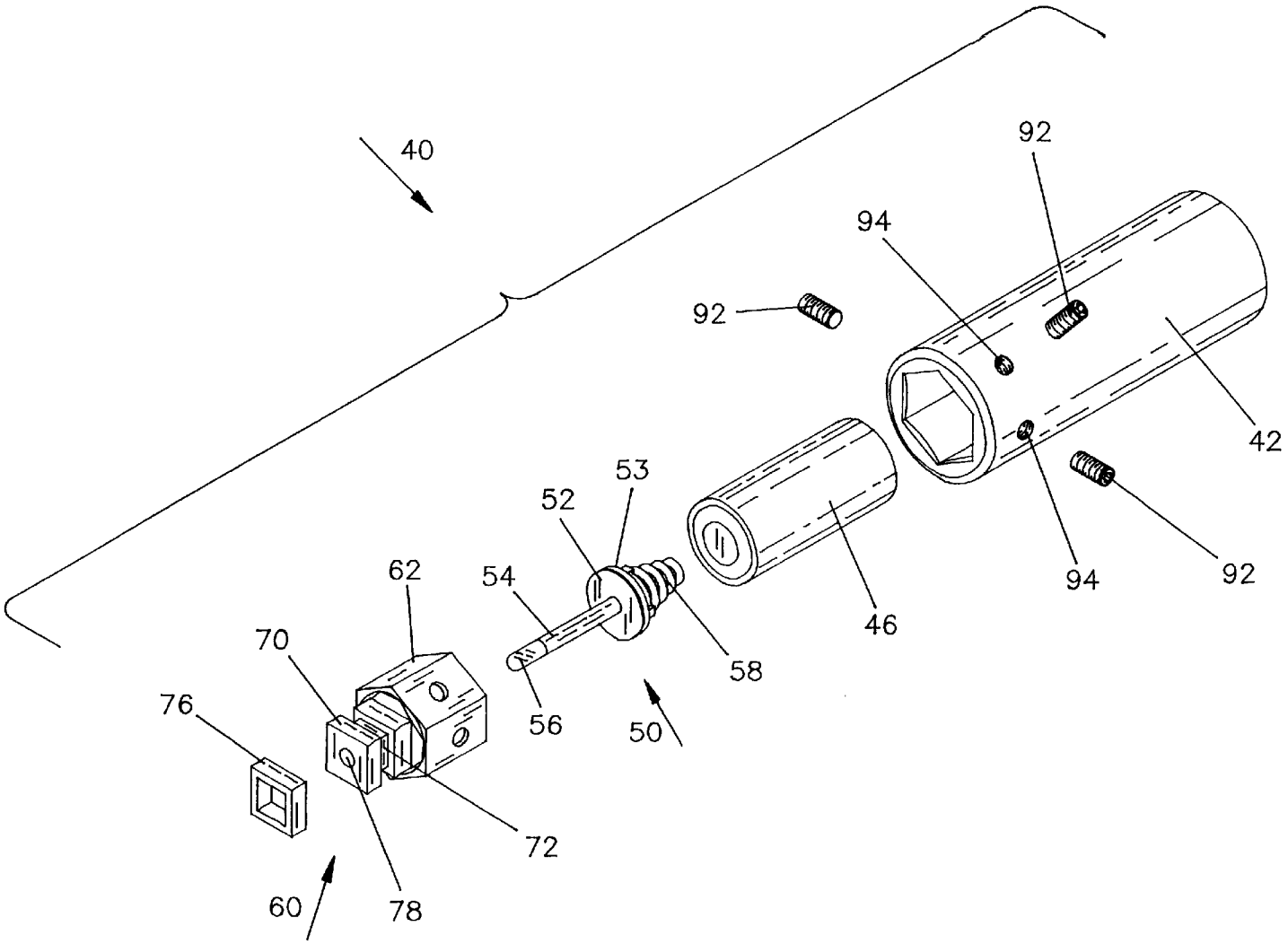
FIG. 5 shows an exploded view of another alternative embodiment of the socket extension of the present invention.

Another alternative way of securing the socket tool mounting element 60 into the extension body 42 is shown in FIG. 5. The extension body 42 is provided with a plurality of set screws 92, such as the three set screws 92, each having an associated set screw threaded aperture 94. When the battery 46, the light assembly 50 and the hexagonal body 62 are assembled into the interior of the extension body 42, each of set screws 92 are screwed into place and the end of each set screw 92 engages the outer surface of the hexagonal body 62 to securely hold the hexagonal body 62 inside the extension body 42.

Figure 6:
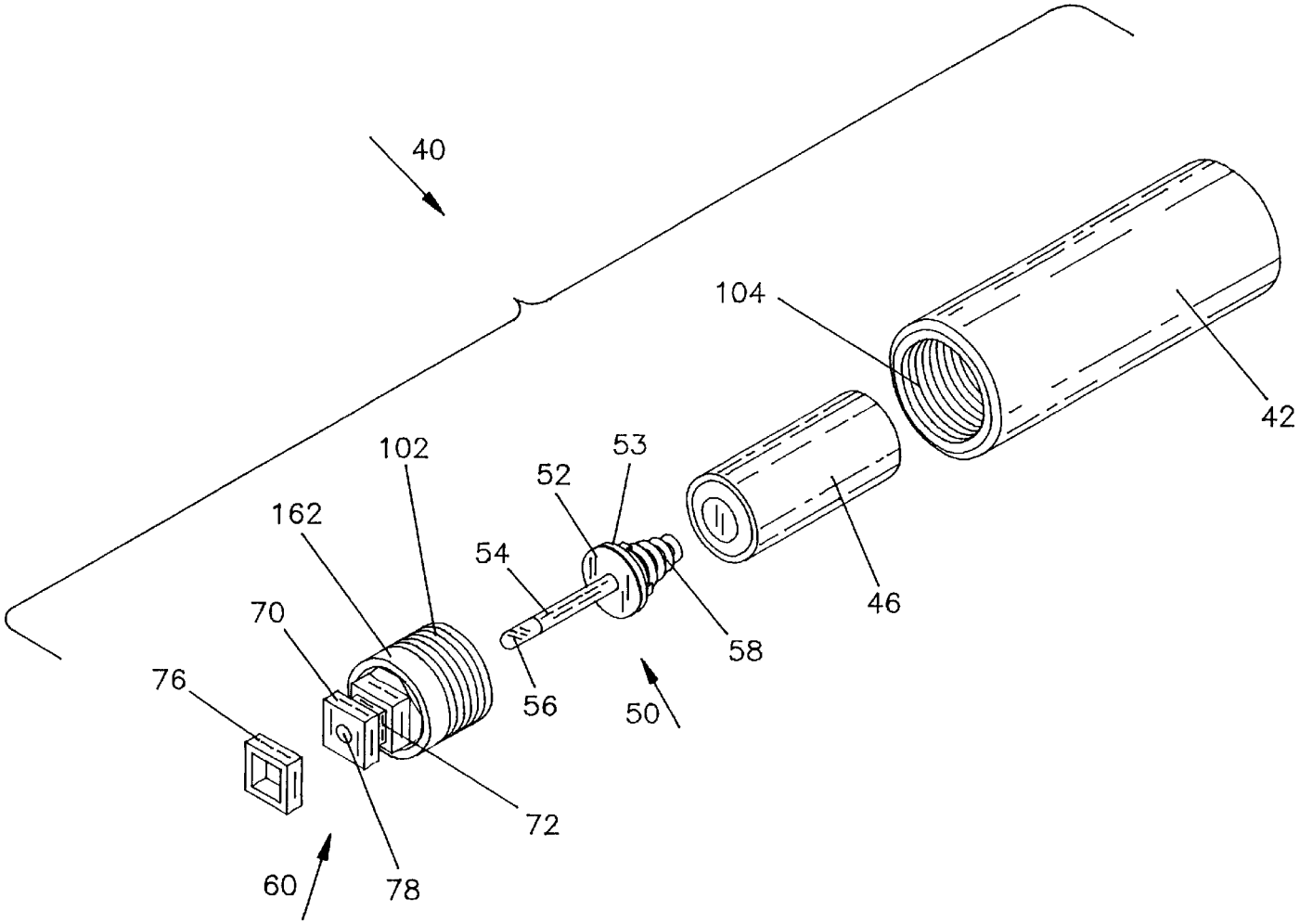
FIG. 6 shows an exploded view of yet another alternative embodiment of the socket extension of the present invention.

FIG. 6 shows yet another alternative way of securing the socket tool mounting element 60 into the extension body 42. The extension body 42 is provided with a threaded interior portion 104 that interacts with a threaded exterior portion on the circular body 162. (The hexagonal body 62 used in the embodiment shown in FIG. 2 must be replaced by the circular body 162 having a circular cross section to allow the circular body 162 to be screwed into the extension body 52.) When the battery 46 and the light assembly 50 are assembled into the interior of the extension body 42, the assembly is completed by screwing the circular body 162 into the threaded portion 104 of the extension body 62 to securely hold the circular body 62 inside the extension body 42.

Figure 7:
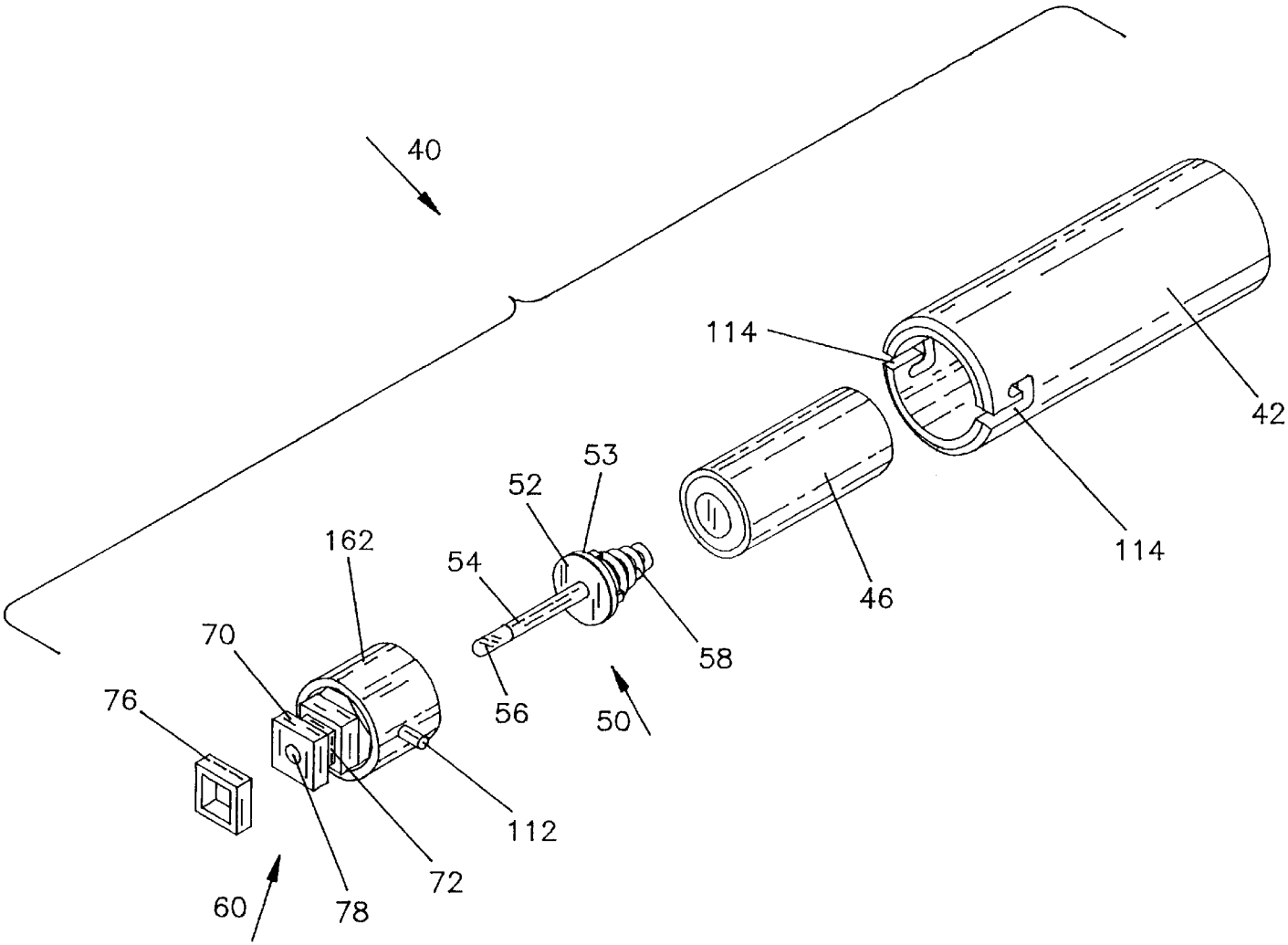
FIG. 7 shows an exploded view of still another alternative embodiment of the socket extension of the present invention.

Still another alternative way of securing the socket tool mounting element 60 into the extension body 42 is shown in exploded view in FIG. 7. The extension body 42 is provided with a plurality of bayonet slots 114, such as two bayonet slots 114 shown in FIG. 7, and the hexagonal body 62 is provided with associated bayonet pegs 112 on its outer surface thereof. When the battery 46 and the light assembly 50 are assembled into the interior of the extension body 42, the hexagonal body 62 is inserted into the extension body 42 so that the bayonet pegs 112 on the surface of the hexagonal body 62 engage the bayonet slots 114 in the extension body 42. The bayonet pegs 112 are inserted into the bayonet slots 114, given a slight twist and pulled back slightly so that the bayonet pegs 112 are secured into the bayonet slot 114 to securely hold the hexagonal body 62 inside the extension body 42.

Other suitable connection structures may be used without departing from the scope of the present invention.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A socket extension comprising:

a) a hollow socket body;

b) at least one battery mounted inside the hollow socket body;

c) a light assembly mounted partially inside the hollow socket body adjacent to the battery; and d) a socket tool mounting element positioned partially inside the hollow extension body and surrounding a portion of the light assembly, the socket tool mounting element comprising:

1) a hexagonal body sized to fit into the hollow extension body and securely held therein by means of a snap ring which cooperates with a snap ring groove on the interior of the extension body; and 2) a socket tool connection head joined to the body.

2. The socket extension of claim 1 in which the socket tool connection head includes an annular channel therein with an O-ring mounted in the annular channel.

3. The socket extension of claim 2 in which the O-ring is generally square in cross section.

4. The socket extension of claim 1 in combination with a socket tool.

5. The socket extension of claim 1 in combination with a socket wrench handle.

6. The socket extension of claim 1 in combination with a socket tool and a socket wrench handle.

7. A socket extension comprising:

a) a hollow socket body;

b) at least one battery mounted inside the hollow socket body;

c) a light assembly mounted partially inside the hollow socket body adjacent to the battery; and d) a socket tool mounting element positioned partially inside the hollow extension body and surrounding a portion of the light assembly, the socket tool mounting element comprising:

3) a hexagonal body sized to fit into the hollow extension body and securely held therein by means of at least one set screw which is threadeably engaged into an outer surface of the hexagonal body through a cooperating set screw threaded aperture in the extension body; and 4) a socket tool connection head joined to the body.

8. The socket extension of claim 7 in which the socket tool connection head includes an annular channel therein with an O-ring mounted in the annular channel.

9. The socket extension of claim 8 in which the O-ring is generally square in cross section.

10. The socket extension of claim 7 in combination with a socket tool.

11. The socket extension of claim 7 in combination with a socket wrench handle.

12. The socket extension of claim 7 in combination with a socket tool and a socket wrench handle.

13. A socket extension comprising:

a) a hollow socket body;

b) at least one battery mounted inside the hollow socket body;

c) a light assembly mounted partially inside the hollow socket body adjacent to the battery; and d) a socket tool mounting element positioned partially inside the hollow extension body and surrounding a portion of the light assembly, the socket tool mounting element comprising:

5) a circular body sized to fit into the hollow extension body and securely held therein by means of a threaded portion on the outer surface of the circular body which cooperates with a threaded surface on the interior of the extension body; and 6) a socket tool connection head joined to the body.

14. The socket extension of claim 13 in which the socket tool connection head includes an annular channel therein with an O-ring mounted in the annular channel.

15. The socket extension of claim 14 in which the O-ring is generally square in cross section.

16. The socket extension of claim 13 in combination with a socket tool.

17. The socket extension of claim 13 in combination with a socket wrench handle.

18. The socket extension of claim 13 in combination with a socket tool and a socket wrench handle.

19. A socket extension comprising:

a) a hollow socket body;

b) at least one battery mounted inside the hollow socket body;

c) a light assembly mounted partially inside the hollow socket body adjacent to the battery; and d) a socket tool mounting element positioned partially inside the hollow extension body and surrounding a portion of the light assembly, the socket tool mounting element comprising:

7) a circular body sized to fit into the hollow extension body and securely held therein by means of at least one bayonet peg provided on the outer surface of the circular body which interacts with an associated bayonet slot in the extension body; and 8) a socket tool connection head joined to the body.

20. The socket extension of claim 19 in which the socket tool connection head includes an annular channel therein with an O-ring mounted in the annular channel.

21. The socket extension of claim 20 in which the O-ring is generally square in cross section.

22. The socket extension of claim 19 in combination with a socket tool.

23. The socket extension of claim 19 in combination with a socket wrench handle.

24. The socket extension of claim 19 in combination with a socket tool and a socket wrench handle.

* * * * *